US008109168B2

(12) United States Patent
Wurm et al.

(10) Patent No.: US 8,109,168 B2
(45) Date of Patent: Feb. 7, 2012

(54) CONVERTER GEARING HAVING ECCENTRIC BUSHES

(75) Inventors: Gerhard Wurm, Wenden (DE); Christoph Sundermann, Hilchenbach (DE); Rüdiger Grimmel, Netphen (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 33 days.

(21) Appl. No.: 10/489,003

(22) PCT Filed: Aug. 28, 2002

(86) PCT No.: PCT/EP02/09571

§ 371 (c)(1),
(2), (4) Date: Mar. 5, 2004

(87) PCT Pub. No.: WO03/023072

PCT Pub. Date: Mar. 20, 2003

(65) Prior Publication Data

US 2005/0012253 A1 Jan. 20, 2005

(30) Foreign Application Priority Data

Sep. 11, 2001 (DE) ..... 101 44 614

(51) Int. Cl.
*F16D 9/06* (2006.01)
*F16C 35/00* (2006.01)

(52) U.S. Cl. ..... 74/412 R; 384/435

(58) Field of Classification Search ..... 74/314, 74/412 R; 384/217, 435, 437, 538
See application file for complete search history.

(56) References Cited

U.S. PATENT DOCUMENTS 1,524,999 A * 2/1925 Sandberg ..... 384/538
4,550,955 A * 11/1985 Grabher et al. ..... 384/45
6,299,829 B1 * 10/2001 Chichery et al. ..... 266/245

FOREIGN PATENT DOCUMENTS

DE 4307535 A1 * 9/1994
EP 1022482 7/2000
GB 590202 7/1947
GB 809683 3/1959

OTHER PUBLICATIONS

English translation of DE4307535.*

* cited by examiner

*Primary Examiner* — James Pilkington
(74) *Attorney, Agent, or Firm* — Lucas & Mercanti, LLP; Klaus P. Stoffel

(57) ABSTRACT

The invention relates to a converter gearing, comprising a gear rim (7), which is connected to the pivoting axis (6) of a converter box, said gear rim being engaged with at least one drive pinion (8) of the converter gearing (9) and at least one locking device, which can be pivoted to engage with and be disengaged from the toothed gearing of the gear rim, (7) in the form of a locking arm (12) that is positioned on a horizontal shaft (10) and configured with toothed gearing (11). The aim of the invention is to improve said locking device. To achieve this, the shaft (10) of the locking arm (12) is mounted in at least one terminal bearing (13, 13') and the locking arm (12) can be engaged with and disengaged from the toothed gearing of the gear rim (7) in a non-positive manner, preferably by means of active force elements (14, 14') in its end regions. In addition, the shaft (10) of the locking arm (12) is mounted in the housing of the converter gearing (9) by means of two eccentric bushes (4, 5), which rotate freely within one another, at each of its ends. The mounting is configured in such a way, that by the independent rotation of the same, an ideal mutual engagement position of the two interacting toothed gearing regions of the locking device (12) and the gear rim (7) can be set.

3 Claims, 6 Drawing Sheets

CONVERTER GEARING HAVING ECCENTRIC BUSHES

BACKGROUND OF THE INVENTION

The invention concerns converter gearing, which comprises a gear rim, which is connected to the axis of rotation of a converter vessel and engages at least one drive pinion of the converter gearing, and at least one locking device, which can be swung in or out to engage with or disengage from the teeth of the gear rim and has the form of a locking arm, which is mounted on a horizontal shaft and is configured with teeth, wherein the shaft is supported in a terminal bearing, the locking arm can be nonpositively engaged with or disengaged from the teeth by active force elements, e.g., hydraulic cylinders, and the shaft is supported in the housing of the converter gearing by two eccentric bushes, which rotate freely, one within the other, at each end of the shaft, in such a way that an ideal engagement position of the interacting toothed regions of the locking device and the gear rim can be set by independent rotation of the eccentric bushes, and a clamping element for adjusting a low-backlash bearing is associated with each of the eccentric bushes and the bores which hold the eccentric bushes.

Converter gears are subjected to high and variable torques during the oxygen-blowing operation. These torques usually lead to extreme loads per unit surface area and thus to excessive wear of the teeth.

It is well known that the harmful loads can be significantly reduced by the use of a locking arm. The terminal toothing of the locking arm for locking engagement in the teeth of the gear rim on the converter vessel corresponds as a "negative form" to about 5 to 6 tooth spaces of the driven gear. The load thereby evenly distributed to a region of the toothing results in a significant reduction of the surface pressure on the toothing and thus a reduction of the wear caused by the surface pressure.

A disadvantage of this design is the required setting precision of the locking lever and its bearing, especially when two independent locking levers are installed. This means that even small deviations from the ideal engagement position can lead to extremely high forces and stresses and thus to faster wear of the gear rim and the locking arm teeth.

To avoid these consequences, use was made of the measure of machining the housing and locking arm bore together. To do this, it is necessary to preassemble the gear rim and locking arm in their optimum position in the housing, then to fasten them in place and, finally, to machine them together.

This not only results in high production costs, but also has the further disadvantage that subsequent replacement or readjustment of the locking arm is not possible due to the special machining sequence.

The document EP 1 022 482 A1 describes a device for locking an element of a kinematic chain on a casting ladle, which comprises a part with an area of relief-like elevations and depressions provided on its periphery, which are complementary to areas with relief-like depressions and elevations on the element to be locked, and a device, which is installed at the end of a locking arm, for moving the part between a passive position "disengaged" from the element to be locked and an active position, in which the elevated and depressed areas of the element and the part penetrate each other to lock the element in a predetermined position. Indicating devices for the element in the predetermined position with respect to its elevated and depressed areas and devices for indicating the position of the locking arm are also provided.

The document GB 809 683 A concerns an improvement of the adjustable bearings of bolts, shafts, and similar elements. It describes the possibility of being able to adjust the position of these elements in all radial directions. Eccentric bushes that can be rotated one within the other are used for this purpose. The inner bush holds the shaft, while the outer bush is mounted in the housing. This produces the required possibilities for adjusting the shaft in all radial directions.

To maintain an adjusted position in a locking device, the document GB 590 202 A proposes that the eccentrics be locked on conical, rotationally symmetric plates by an outer screw connection with a set bolt. It is readily apparent that this is an extremely expensive and complex arrangement that requires a considerably greater construction space.

SUMMARY OF THE INVENTION

Proceeding from the prior art described above, the objective of the invention is to produce converter gearing of the type specified in the introductory clause of claim 1 with an improved design and to design it in such a way that the optimum setting precision of the locking lever relative to the gear rim of the gearing can be readjusted at any time independently of the production of these elements.

In accordance with the invention, to achieve this objective in converter gearing of the type described above, it is proposed that the clamping element is a clamping bush that can be expanded in its inside and outside diameter by means of axial keys.

The design of the support of the locking arm in accordance with the invention results in the great advantage that optimum adjustability of the backlash of the drive toothing of the gearing can be achieved at any time and independently of its production, and/or the backlash can be readjusted. This results in an even load distribution in the region of the locking teeth with about 5 to 6 tooth spaces of the region of engagement of the driven gear with drastically reduced load per unit surface area of the tooth flanks. The wear of the gear wheels of the gearing is reduced accordingly.

A method of adjusting a low-backlash bearing of the shaft of the locking arm of a design in accordance with the invention is distinguished by the fact that an optimum engagement of the toothed region of the locking device is first set by rotation of the eccentric bushes of the shaft with the clamping elements released, and that the clamping elements of the two terminal bearings are then brought into a low-backlash bearing state by expansion, and the eccentric bushes are locked in the setting they have then reached.

Further details, features, and advantages of the invention are revealed by the following explanation of several embodiments, which are shown schematically in the drawings.

DETAILED DESCRIPTION OF THE INVENTION

Figure 1:
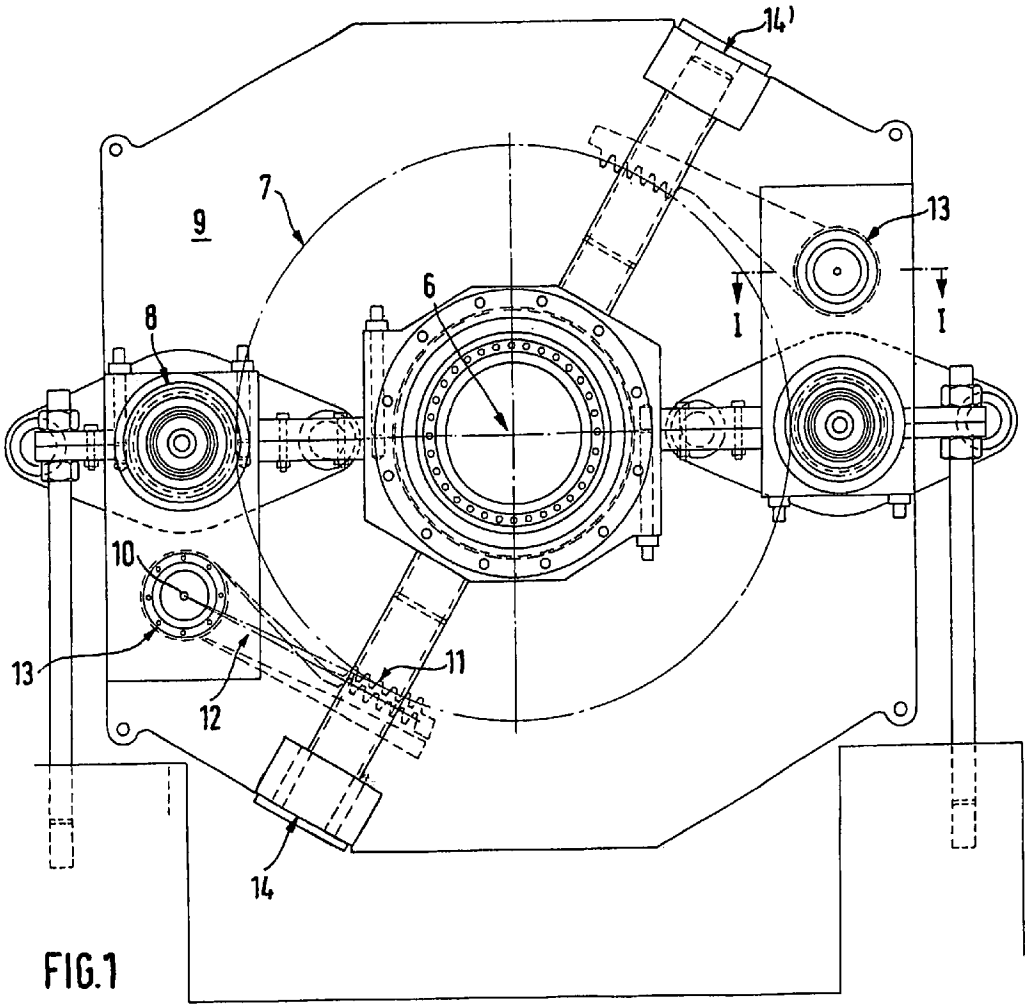
FIG. 1 shows converter gearing in a side view.
Figure 2:
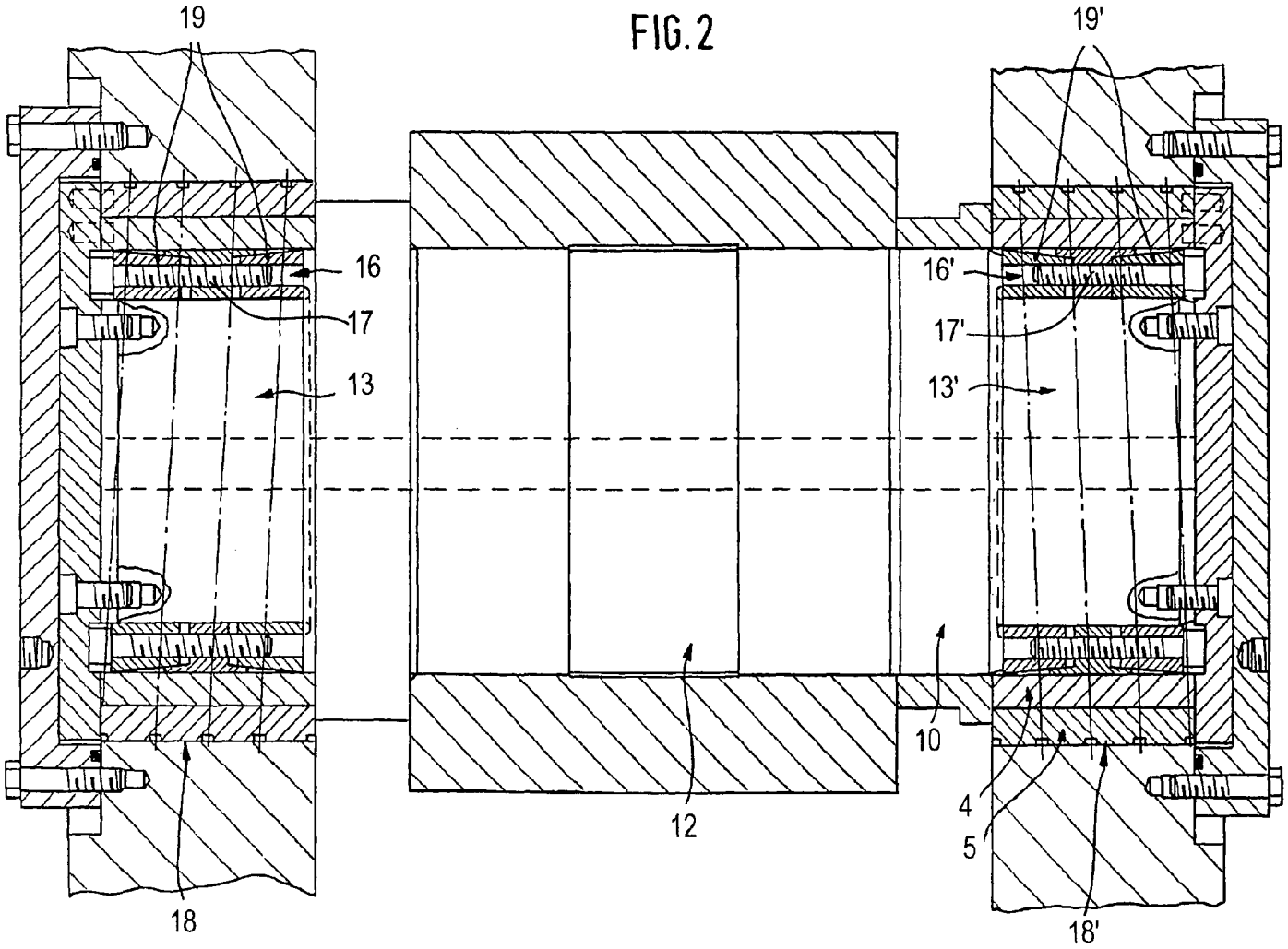
FIG. 2 shows the mounting of the shaft of a locking arm in eccentric bushes in the sectional plane indicated by I-I in FIG. 1.

FIG. 1 shows a side view of converter gearing, which comprises a gear rim 7, which is connected to the axis of rotation 6 of a converter vessel (not shown) and engages at least one drive pinion 8 of the converter gearing 9, and at least one locking device, which can be swung in or out to engage with or disengage from the teeth of the gear rim 7 and has the form of a locking arm 12, which is mounted on a horizontal shaft 10, is configured with teeth 11 in its end region, and is rotatably supported.

The locking arm 12 is supported with the shaft 10 in at least one terminal bearing 13, 13' and can be nonpositively engaged with the teeth of the gear rim 7 or disengaged from the teeth of the gear rim 7 by means of active force elements 14, 14', e.g., hydraulic cylinders, which preferably act on its end regions. The shaft 10 of the locking arm 12 is supported in the housing of the converter gearing 9 by two eccentric bushes 4, 5, which rotate freely, one within the other, at each end of the shaft 10. An ideal mutual engagement position of the two interacting toothed regions of the locking device 12 and the gear rim 7 can be set by independent rotation of the eccentric bushes 4, 5.

A clamping element 16, 16' for adjusting a low-backlash bearing 13, 13' is associated with each of the eccentric bushes 4, 5 and the bores 18, 18' of the converter gearing 9 which hold the eccentric bushes. This can be accomplished if, for example, the clamping element 16 is a clamping bush 19 that can be expanded in its inside and outside diameter by means of axial keys 17.

The adjustment of a backlash-free bearing 13, 13' of the shaft 10 of a locking arm 12 of the locking device and the adjustment of optimum engagement of the toothed region of the locking arm 12 with the gear rim 7 of the converter gearing 9 are accomplished by rotation of the eccentric bushes 4, 5 with the clamping elements 16 released. The clamping elements 16 of the two terminal bearings 13, 13' are then brought into a low-backlash bearing state by expansion, and the eccentric bushes 4, 5 are locked in their setting.

FIGS. 3 to 6 show different states of the penetration of the outer eccentric bushes 5 by the inner eccentric bushes 4.

In these drawings, the centers of rotation of the outer bushes 5 are labeled with the reference number "1", the centers of rotation of the inner bushes 4 are labeled with the reference number "2", and the centers of the bores in the inner bushes 4 are labeled with the reference number "3".

Figure 3:
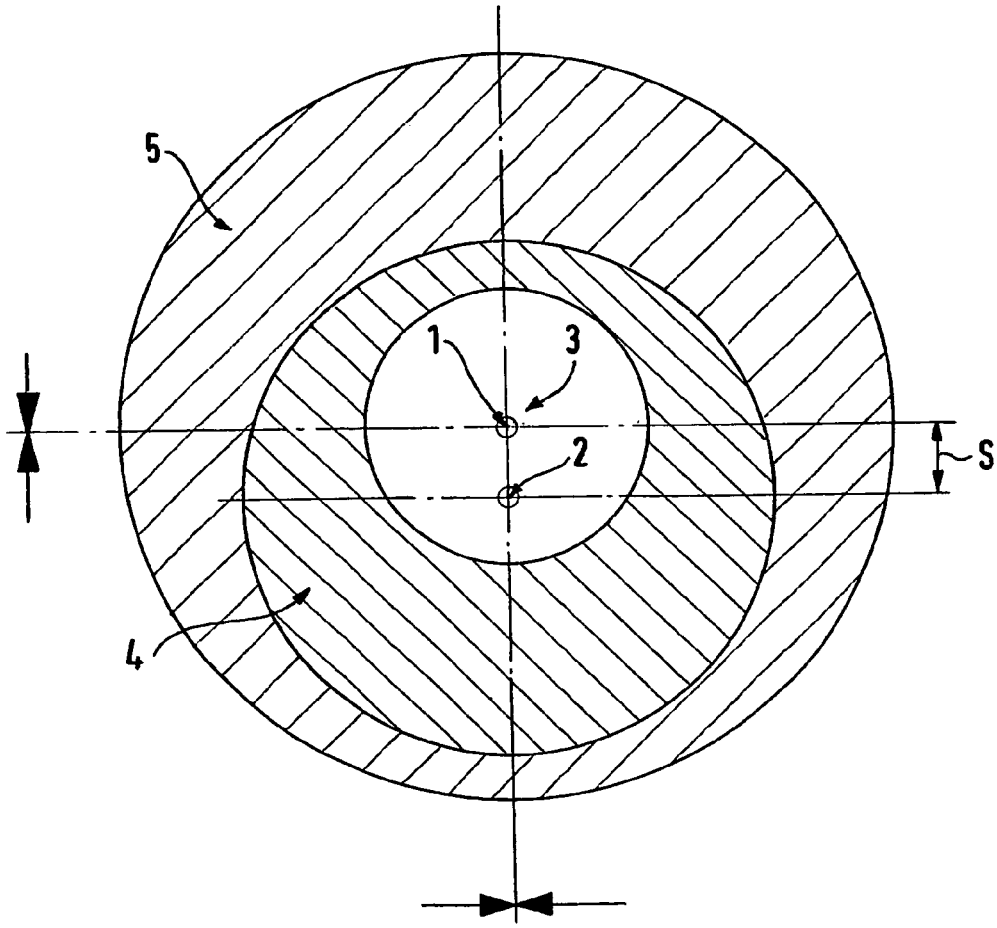
FIG. 3 shows an axial cross section of a pair of eccentric bushes mounted one inside the other in an eccentric position.
Figure 4:
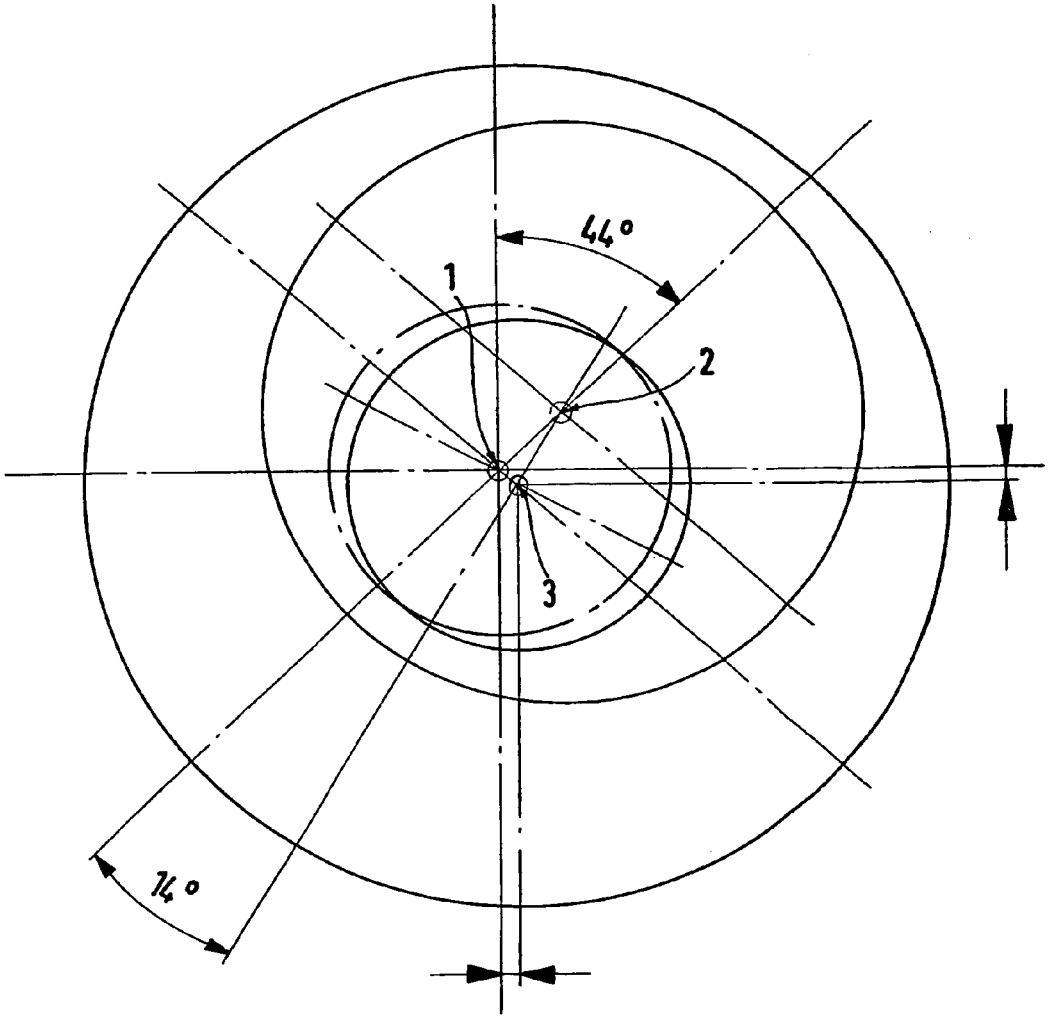
FIG. 4 shows various eccentric positions of eccentric bushes mounted one inside the other.
Figure 5:
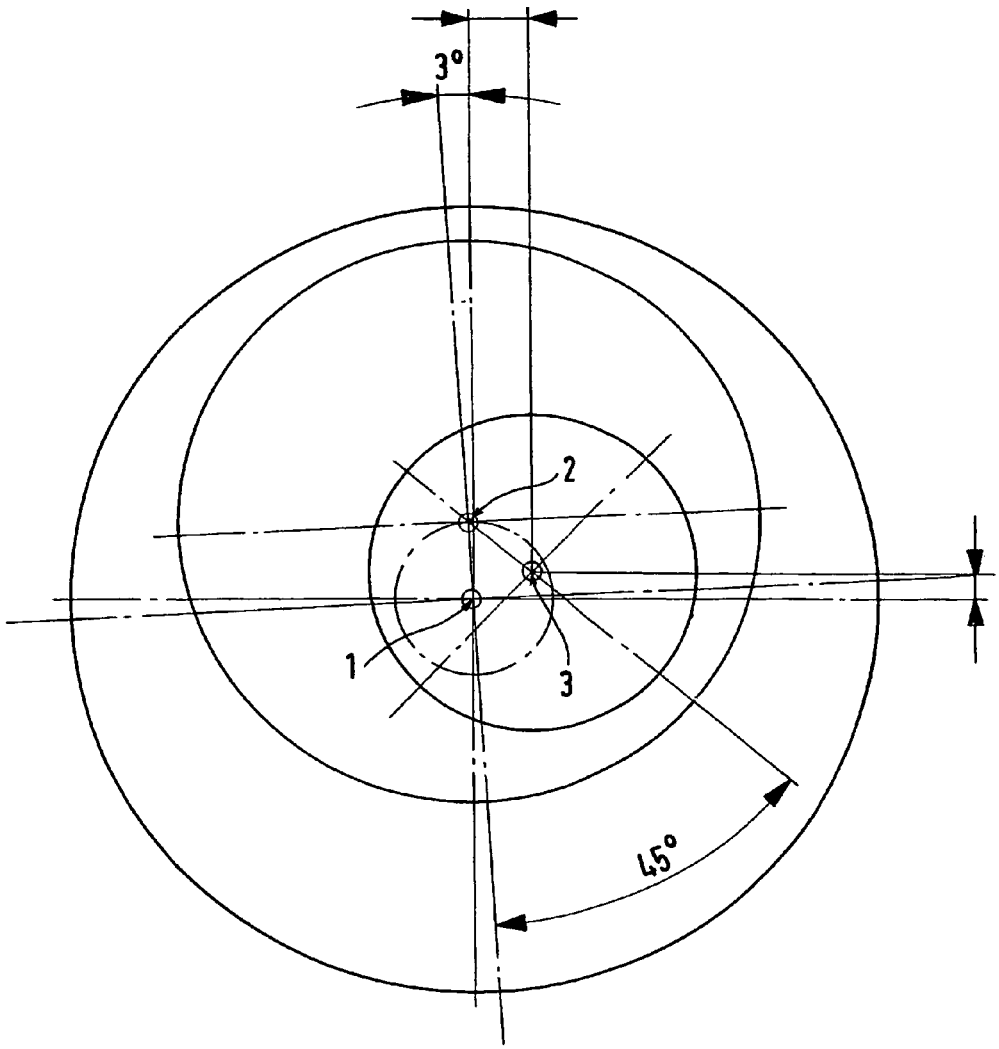
FIG. 5 shows another eccentric position of eccentric bushes mounted one inside the other.
Figure 6:
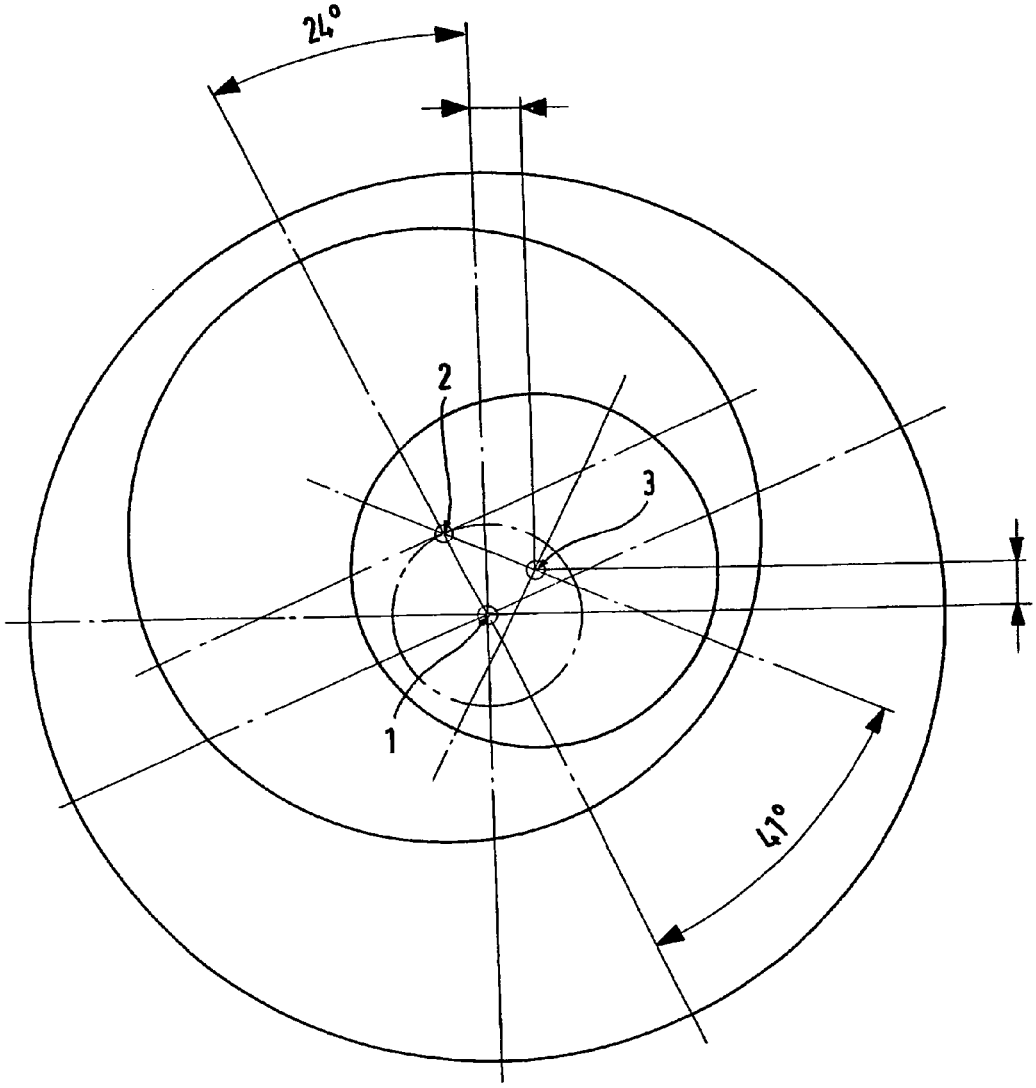
FIG. 6 shows another eccentric position of eccentric bushes mounted one inside the other.

FIG. 3 shows the so-called zero position, in which the eccentricities of the two bushes offset each other. The eccentricity of a bush is thus characterized by the indicated distance "S".

LIST OF REFERENCE NUMBERS

1 center of outer bush
2 center of inner bush
3 center of a bore of the inner bush
4 inner eccentric bush
5 outer eccentric bush
6 axis of rotation of the converter vessel
7 gear rim
8 drive pinion
9 converter gearing
10 horizontal shaft
11 toothing
12 locking arm
13 bearing
14 active force element
16 clamping element
17 axial keys
18 bore

The invention claimed is:

1. Converter gearing, which comprises a gear rim (7), which is connected to an axis of rotation (6) of a converter vessel and engages at least one drive pinion (8) of the converter gearing (9), and two locking devices, which can be swung in or out to engage with or disengage from the teeth of the gear rim (7) and have the form of a locking arm (12), which is mounted on a horizontal shaft (10) and is configured with teeth (11), wherein the shaft (10) is supported in a terminal bearing (13, 13'), the locking arm (12) can be engaged with or disengaged from the teeth (11) of the gear rim by active force elements, and the shaft (10) is supported in a housing of the converter gearing (9) by two eccentric bushes (4, 5), which rotate freely, one within the other, at each end of the shaft, in such a way that an ideal engagement position of the interacting toothed regions of the locking device (12) and the gear rim (7) is set by independent rotation of the eccentric bushes, and a clamping element (16, 16') for adjusting a low-backlash bearing (13) is associated with the eccentric bushes (4, 5) and bores (18, 18') which hold the eccentric bushes, wherein the eccentric bushes are cylinders and each have a uniform inner diameter, and wherein the clamping element (16) is an expandable clamping bush (19) having two wedge-shaped elements movable axially relative to one another so that an inside diameter and an outside diameter of the clamping bush are expandable by means of axial keys (17') so as to radially tension the eccentric bushes and lock the eccentric bushes in a setting for a low-backlash bearing state of the bearing, each of the wedge-shaped elements having a radially inner surface parallel to a central axis of the horizontal shaft, and an angled, radially outer surface.

2. The converter gearing according to claim 1, wherein the active force elements are hydraulic cylinders (14, 14').

3. Method of adjusting a low-backlash bearing of the shaft (10) of a locking arm (12) of a locking device on a the converter gearing (9) for the purpose of optimum engagement of a toothed region of the locking device (12), wherein an optimum engagement of the toothed region of the locking device is first set by rotation of eccentric bushes (4, 5) with clamping elements of the low-backlash bearing released, and that the clamping elements (16) of the low-backlash bearing (13, 13') are then brought into a low-backlash bearing state by expansion of inside and outside diameters of the clamping elements by axial keys, and the eccentric bushes (4, 5) are locked in their setting for the low-backlash bearing state, the clamping element (16) having two wedge-shaped elements movable axially relative to one another so that the inside diameter and the outside diameter of the clamping element are expanded by the axial keys (17') so as to radially tension the eccentric bushes, each of the wedge-shaped elements having a radially inner surface parallel to a central axis of the horizontal shaft, and an angled, radially outer surface.

* * * * *